US009776436B2

(12) United States Patent
Chanclon et al.

(10) Patent No.: US 9,776,436 B2
(45) Date of Patent: Oct. 3, 2017

(54) CONTROL OF A PRINT DEVICE

(71) Applicant: HEWLETT-PACKARD DEVELOPMENT COMPANY, L.P., Houston, TX (US)

(72) Inventors: David Chanclon, Barcelona (ES); Alberto Borrego Lebrato, Barcelona (ES); Juan Francisco Redondo Del Campo, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/312,630

(22) PCT Filed: Jun. 2, 2014

(86) PCT No.: PCT/EP2014/061404
§ 371 (c)(1),
(2) Date: Nov. 19, 2016

(87) PCT Pub. No.: WO2015/185101
PCT Pub. Date: Dec. 10, 2015

(65) Prior Publication Data

US 2017/0182800 A1 Jun. 29, 2017

(51) Int. Cl.
*B41J 13/00* (2006.01)
*B41J 11/42* (2006.01)

(52) U.S. Cl.
CPC ..... *B41J 13/0009* (2013.01); *B41J 11/42* (2013.01)

(58) Field of Classification Search
CPC ..... B41J 11/42; B41J 2/04573; B41J 19/205; B41J 29/38; B41J 13/0009; B41J 29/393; B41J 2/04505
See application file for complete search history.

(56) References Cited

U.S. PATENT DOCUMENTS

| | | | | |
|---|---|---|---|---|
| 6,170,933 | B1 | 1/2001 | Nitta et al. | |
| 6,788,324 | B2 | 9/2004 | Fisher et al. | |
| 7,530,657 | B2 | 5/2009 | Thiessen et al. | |
| 7,694,965 | B2 | 4/2010 | Bruhn et al. | |
| 2004/0061732 | A1 | 4/2004 | Takeuchi | |
| 2006/0017764 | A1 | 1/2006 | Kang et al. | |
| 2007/0103496 | A1* | 5/2007 | Otani | B41J 2/04573 347/11 |
| 2008/0030536 | A1 | 2/2008 | Furukawa et al. | |
| 2009/0219552 | A1 | 9/2009 | Igarashi | |

FOREIGN PATENT DOCUMENTS

| | | |
|---|---|---|
| EP | 1334836 | 10/2000 |

OTHER PUBLICATIONS

Cho, Youngwari. An Impact Position Control of the Ink Droplet of Inkjet Printer Jun. 2-5, 2005.

* cited by examiner

*Primary Examiner* — Thinh H Nguyen
(74) *Attorney, Agent, or Firm* — HP Inc.—Patent Department

(57) ABSTRACT

A method for controlling a print device by generating a firing encoder signal from varying one or more characteristics of a reference signal where, the one or more characteristics are varied based on at least the position of a print medium at a reference time. The firing encoder signal is used to synchronize firing of at least one print head of the print device after the reference time.

15 Claims, 5 Drawing Sheets

CONTROL OF A PRINT DEVICE

BACKGROUND

In a print device an image is printed on a print medium. Typically a print, device, such as an inkjet printer, comprises one or more print heads that, are arranged to deposit a printing fluid such as ink upon the print medium. The one or more print heads are typically controlled by a print controller. Such a print controller receives an input image to be printed and generates a number of signals to control the print device. Based on these signals the printing fluid is ejected from the one or more print heads. Many print devices incorporate some form of relative movement between the print medium and the one or more print heads so that printing fluid is deposited onto an appropriate area of the print medium. The print controller thus coordinates the timing of the signals needed to control the print device such that an output image is printed in the right place on a print medium.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

Figure 1:
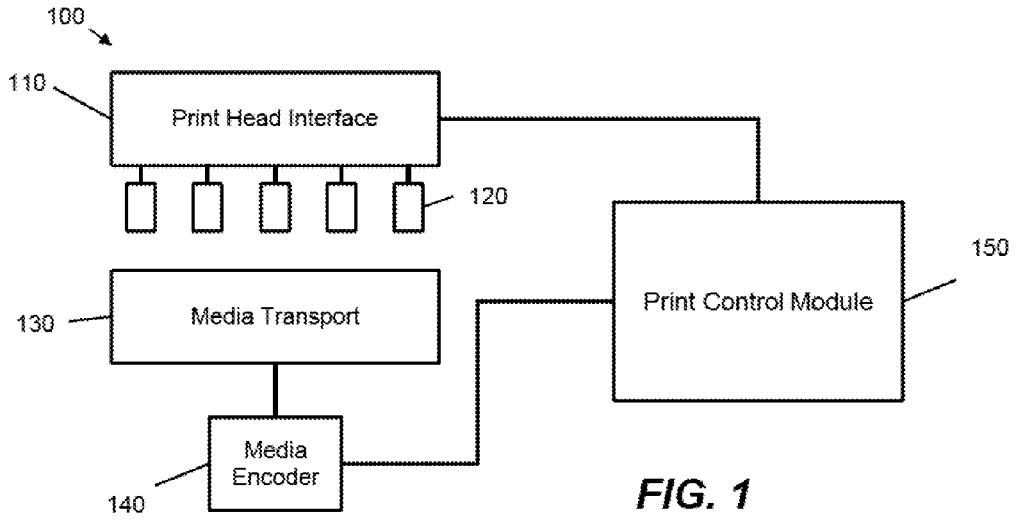
FIG. 1 is a schematic diagram showing components of a printing system.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Certain examples described herein relate to printing systems and methods of printing. In particular, certain examples relate to ink-jet printing systems that move a print medium in relation to one or more ink-jets. The movement may be due to the movement of an ink-jet across the width of the print medium, or in the case of page-wide array printing, the movement of the medium itself through an ink-jet running across the width of the medium. The ink-jet is generated by ejecting ink from one or more print heads of the printing system. The firing of said print heads may be controlled by controlling the ejection of ink from one or more nozzles of the print head. A nozzle may comprise an ink chamber and a piezoelectric element, wherein activation of the piezoelectric element via a firing pulse ejects ink from the chamber and through the nozzle. Nozzles may be arranged according to print dies, e.g. portions of common silicon substrate.

In these cases, the printing system, or in some cases an external control system, generates a firing pulse signal that controls the deposit of ink on print media. The firing pulse signal has a particular timing or frequency. To achieve high print quality and/or minimize any print errors it is desirable that the firing pulse signal is synchronized with the relative movement of a print medium. This may comprise synchronizing the timing of a firing pulse signal with the movement of the print medium in respect of the one or more ink-jets.

In an example printing system, a media transport system ("media transport" for short) may be arranged to transport print media relative to a print head. In a page-wide array printer, one or more print heads may be mounted on a print bar above a media transport path. In these cases the media transport may transport a print medium underneath the print heads. In certain cases, the media transport may comprise a system that moves the one or more print heads in relation to a print medium; in other cases a combination of print head and print media movement may be effected.

In examples, a state of a media transport may be determined using one or more encoders. Depending on the system these may comprise one or more linear and/or rotary encoders. For example, if the media transport comprises one or more rollers, and/or a belt system, a rotary encoder may be coupled to one of the roller or a drive mechanism such as an electric motor. In these cases, the print medium may be carried by the rollers and/or belt under the print heads. In another case, a linear encoder may track the print media as it moves along a linear path. In each case the encoders may generate an encoder signal representative of the media transport state. This encoder signal may be used to synchronize one or more firing pulse signals.

In comparative examples, fluctuations and deviations from normal operating properties, such as roller and/or belt vibrations due to high-speed operation, may lead to fluctuations in the media transport signal. This can be problematic when synchronizing one or more firing pulse signals. In further comparative examples, other fluctuations and deviations such as slippage of a print medium in respect of the media transport and/or media-specific fluctuations such as curling or snagging can cause the firing pulse signal frequency to be out of synch with the encoder signal.

Certain methods and systems described herein seek to minimize the impact of printing errors that arise due to fluctuations and/or deviations from normal operating properties. Certain methods described herein re-synchronize one or more firing pulse signals to the position of print media using a predictive position following method. This helps to overcome the effects of fluctuations and maintain print quality.

FIG. 1 shows an exemplary printing system 100. Certain examples described herein may be implemented within the context of this printing system. In the example of FIG. 1, one or more print heads 120 may be arranged to deposit printing fluid on a print medium through nozzles. The print heads are communicatively coupled to a print head interface 110. Print heads 120 may be arranged across the width of a media as in a page wide array printer, or may be arranged as in a scanning ink-jet printer, whereby a print head is moved across the width of the page itself. The print head interface 110 is a tinged to receive a firing pulse signal f it control module 150.

In FIG. 1 media transport 130 is arranged to transport a print medium in relation to the print heads 120. Media transport 130 is coupled to a media encoder 140 which is arranged to capture one or more properties of the media transport 130 and generate a signal. The signal may be representative of one or more of a state of the media transport 130 or a state of a print medium being transported by the media transport. In an example, the media encoder 140 generates an encoder signal which is indicative of the movement of the print media with respect to the media transport. In certain cases, the media encoder signal may be processed to take into account one or more media properties of a print media, e.g. size, material and/or weight as determined from print configuration data. Print control module 150 is arranged to receive an encoder signal from the media encoder 140 and generate a firing pulse signal which may be sent to the print head interface. The firing pulse signal controls the firing of the nozzles of the one or more print heads 120. Print control module 150 is arranged to synchronize the firing pulse signal with the encoder signal received from the media encoder 140. In an example, print control module 150 is arranged to minimize an error between a position of the print medium based on a timing for the firing pulse signal and a position of the print medium predicted from the encoder signal.

In certain cases, print control module 150 additionally processes the received encoder signal, prior to synchronizing the firing encoder signal. For example in certain cases the encoder signal may comprise an encoder signal from one or more of a rotary and linear encoder. In these cases the encoder signal may be processed by one or more of the media encoder 140 and the print control module 150 to generate a media encoder signal. The media encoder signal may comprise a processed form of the encoder signal. The processing may remove noise from the encoder signal. The processing may also or alternatively comprise filtering and/or calibrating the encoder signal based on one or more hardware and/or media properties parameters. For example, if the media transport 130 comprises one or more rollers, then processing of encoder signals may incorporate properties such as roller diameter and run-out as well as other media-specific properties. In certain cases, a media encoder signal comprises one or more of a position and a speed of a print medium being transported by the media transport 130.

Figure 2:
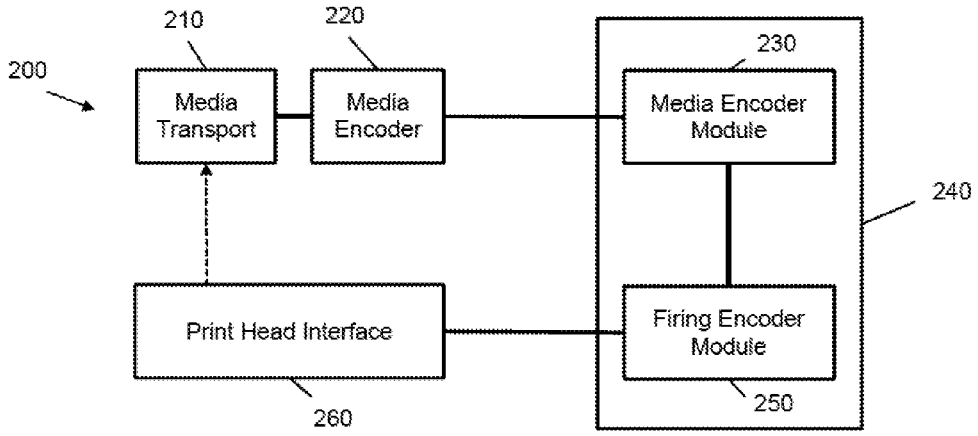
FIG. 2 is a schematic diagram showing components of a print control module according to an example.

FIG. 2 shows the components of a printing system 200 according to an example. In one case these components correspond to the respective components of FIG. 1. Print control module 240 comprises a media encoder module 230 and firing encoder module 250. Media encoder 220 generates a signal as in the case of media encoder 140 in FIG. 1. Media encoder module 230 is arranged to receive a signal from media encoder 220 communicatively coupled to media transport 210. Again, media encoder 220 may comprise a rotary encoder with and/or without additional processing. In the latter case, additional processing may be performed by the media encoder module 230. The processing may comprise the implementation of a Savitzky-Golay filter, e.g. in real time.

In FIG. 2, firing encoder module 250 is coupled to print head interface 260 and is arranged to synchronize a firing encoder signal with a media encoder signal received from media encoder module 230. The firing encoder signal is a second, separate encoder signal from the media encoder signal that is used to generate a firing pulse signal for the print heads; in particular, the firing encoder signal controls the timing of the firing pulse signal. In one embodiment, the firing encoder module 250 synchronizes a future position of the print media as predicted using the media encoder signal with a future position of the print media as predicted using the firing encoder signal. In more detail, the firing encoder signal may be synchronized by modifying its time period. In this case, the time period represents a movement of the print medium over a predetermined distance, e.g. one line with 150 lines per inch (1/150"—approximately 0.17 mm). The time period is modified by the firing encoder module 250 such that a position of the print medium that is predicted from the firing encoder signal at the end of its time period matches a position of the print medium at the end of the time period that is predicted from the media encoder signal.

Figure 3:
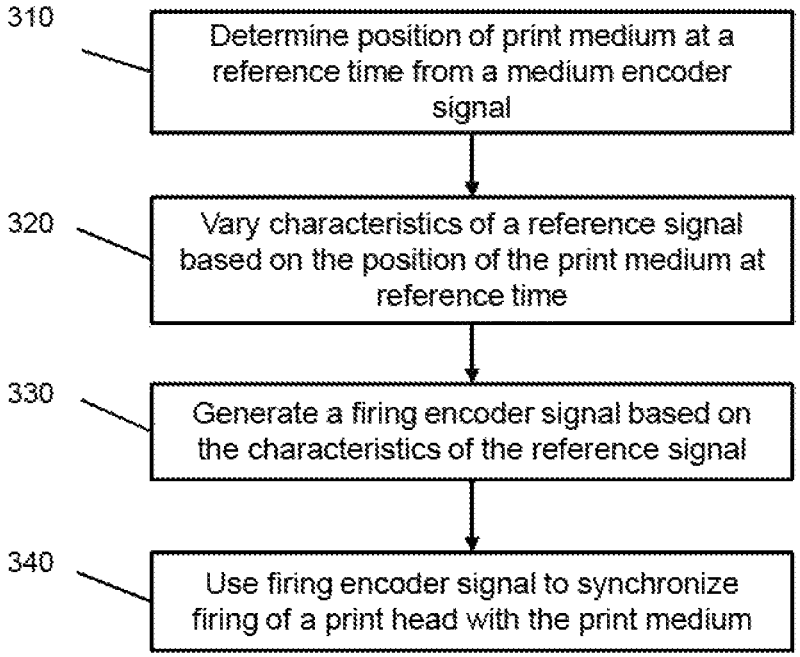
FIG. 3 is a flowchart showing a method of controlling a print device according to an example.

A number of methods are now described. The methods described in herein may be implemented on the systems described in FIGS. 1 and 2. FIG. 3 shows a method for generating a firing encoder signal that may be used to synchronize firing of a print head with a print medium, according to an example. At block 310 a position of a print medium is determined at a reference time. According to an example, the motion of the print medium is controlled by a media transport such as that of FIGS. 1 and 2. In another example, the print medium is itself stationary, and the position of the print medium is given in relation to a movable print head and print head interface. The reference time may be taken to be any time from which a measurement is made. The reference time may comprise a reference point from which all measurements are given, either deterministically or predicted.

At block 320 characteristic properties of a reference signal are varied based on the position of the print medium at the reference time. In an example, the reference signal corresponds to a previously-generated firing encoder signal, as such this block may comprise varying one or more characteristics of the previously-generated firing encoder signal. The one or more one or more characteristics may comprise a timing period or signal frequency. Alternatively, the reference signal may be generated independently and received by a system implementing the method of FIG. 3. In certain cases, the reference signal has a time period representing a movement of the print medium over a predetermined distance (e.g. 1/150"—approximately 0.17 mm in one implementation).

At block 330 a firing encoder signal is generated for a time relative to, for example after, the reference time based on the varied characteristics of the reference signal. In the case where the reference signal has a time period representing a movement of the print medium of a predetermined distance, generating the firing encoder signal may comprise determining an error between a predicted distance moved by the print medium based on at least the determined position of the print medium at the reference time and the predetermined distance. The error determined can then be used to vary the time period of the reference signal to generate a firing encoder signal.

At block 340 the firing encoder signal generated at block 330 is used to synchronize the firing of print heads with a print medium.

Figure 4:
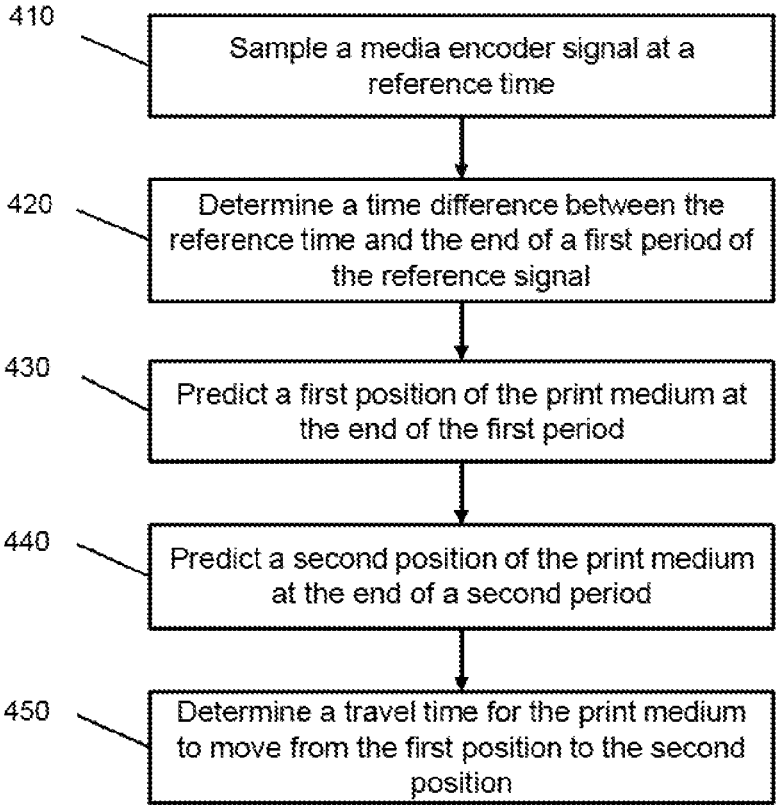
FIG. 4 is a flowchart showing a method of determining a travel time of a print medium according to an example.

FIG. 4 shows an example position follower method which may be implemented by the systems shown in FIGS. 1 and 2. This position follower method may be used to determine a time period for a firing encoder signal. The position follower method applies the constraint that a position of a print medium as predicted from a modified firing encoder signal matches the position of the print medium as determined from a media encoder signal. In these cases the firing encoder signal is a repeating waveform such as a saw-tooth or square wave.

At block 410 a media encoder signal is sampled. In an example sampling may comprise latching a processed encoder signal at an incremental time period, e.g. every 0.4 ms. At block 420 a time difference between the reference time and an end of a first period of the reference signal is determined. At block 430, the time difference calculated at the previous stage is used to predict the position of the print medium at the end of the first period. This prediction is performed based on an initial position and speed at the reference time, for example as determined from the media encoder. In one case the media encoder signal has a value that is representative of a position of the print medium: in this case the speed may be determined by taking the derivative of this signal. At block 440 a position of the media at the end of a second period from the reference signal is predicted. This may be estimated based on the travel distance assumed by Thing encoder signal (e.g. 0.17 mm) and a time difference between the reference time and the subsequent start of the second period (e.g. 0.17*(time_difference/time_period)). At block 450, the travel time for the print medium to move from the first position to the second position can be determined from previously determined values. For example, the difference in the positions determined at blocks 440 and 430 can be determined and divided by the speed at the reference time that was used in block 430. This travel time may then be used to set the time period of the firing encoder signal waveform.

Figure 5:
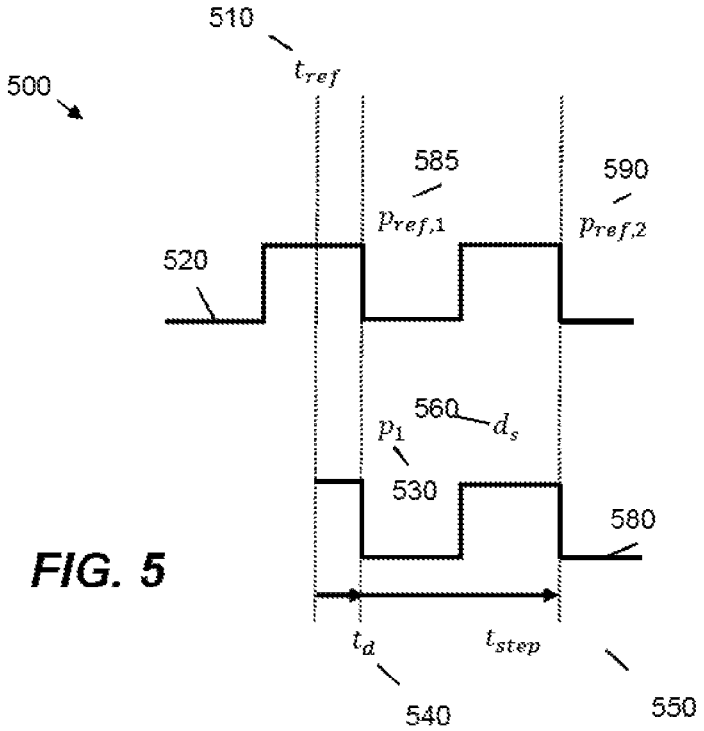
FIG. 5 is a timing waveform diagram showing a number of control signals according to an example

FIG. 5 is a waveform diagram that may be used to illustrate the method of FIG. 4 according to an example. FIG. 5 shows a reference signal 520, represented as a square wave. This is the reference signal from which a firing encoder signal may be generated. In certain cases the media encoder signal may comprise a position value. A future firing encoder signal 580 to be generated is shown with a time period $t_{step}$ that is calculated by varying one or more properties of the reference signal 520 as discussed below.

Block 410 of FIG. 4 takes place at time $t_{ref}$ 510. Here a value is taken from the media encoder signal. This value may comprise an initial position $p(t_{ref})$ at time $t_{ref}$ of the media. A velocity $v(t_{ref})$ may then be determined by differentiating the media encoder signal. Next a time $t_d$ 540 until the end of the first reference signal step can be determined, since the reference signal 520 according to the example, has a known period. At this time, the estimated position of the media according to the media encoder signal can be predicted as:

$$p_1=p(t_d)=p(t_{ref})+v(t_{ref})\times t_d.$$

Following this the second position of the print media 590 as predicted by the reference signal 520 can be determined as:

$$p_{ref,2} = p_{ref,1} + \frac{1}{l}$$

where l is the resolution of the one or more printing heads and $p_{ref,1}$ 585 is the position of the print media at $t_d$ as predicted,by the reference signal. For example, l may equal 150 (e.g. 150 lines per inch); in a metric equivalent 1/l may equal $0.17\times10^{-3}$. The position $p_{ref,1}$ 585 may be determined using the known travel distance in one period (e.g. 0.17 mm) and multiplying it by a proportion of the complete time period taken up by $t_d$. The distance to synchronize $d_s$ 560 the media according to the distances determined from the media encoder signal and the reference signal can be determined as:

$$d_s=p_{ref,2}-p_1.$$

From which a travel time for the print medium to move from the first position to the second position can be determined as:

$$t_{step} = \frac{d_s}{v(t_{ref})}$$

The travel time determines the required time period of a firing encoder signal, to synchronize with the position of a print media. The methods enclosed above are used to resynchronize the position of the print media with the firing encoder signal and not the velocity of the media.

Figure 6:
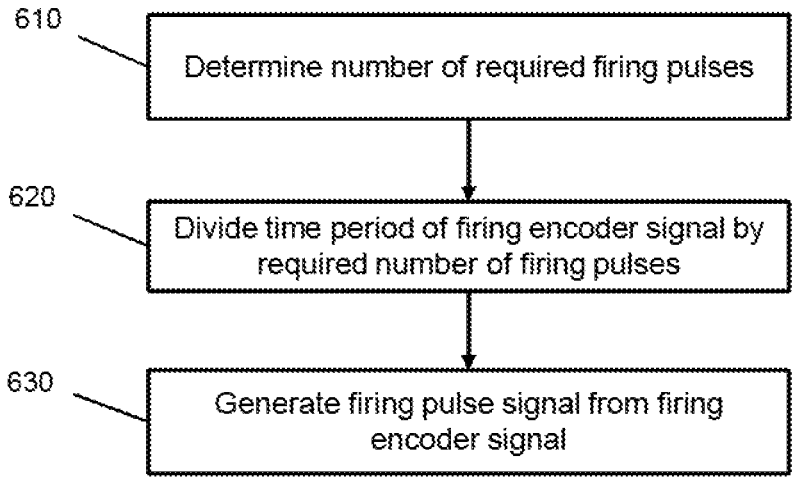
FIG. 6 is a flowchart showing a method for generating a firing pulse signal according to an example.

FIG. 6 shows a method, according to an example, of determining a firing pulse from a firing encoder signal. This method may be used in conjunction with previous methods outlined for determining a firing encoder signal, or may be applied to a signal derived from a firing encoder signal. At block 610 the number of required firing pulses is determined. At block 620, the time period of a firing encoder signal is divided according to the required number of firing pulses. At block 630, the firing pulse signal is generated from the firing encoder signal. The firing pulse signal may be generated by a firing encoder module, such as the firing encoder module 250 of FIG. 2, or may be generated at print head interface 260, receiving a firing encoder signal.

Figure 7:
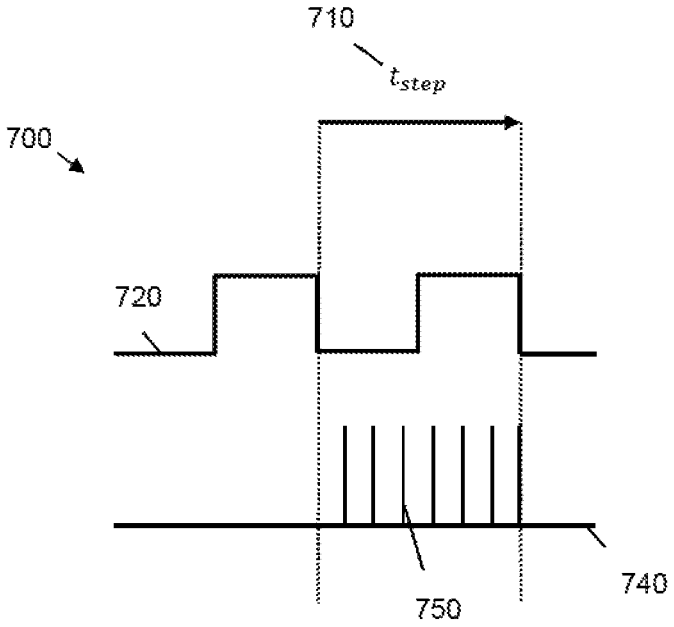
FIG. 7 is a timing waveform diagram showing the generation of firing pulse train according to an example.

FIG. 7 shows a diagram of signals 700 as may be determined by the methods disclosed herein. FIG. 7 shows a modified firing encoder signal 720 and a firing pulse signal 740. The firing pulse signal comprises a number of firing pulses 750, which represent a division of the firing encoder signal 740. In certain embodiments it may be possible to have exactly one firing pulse per firing encoder step, e.g. in certain cases the firing encoder signal may comprise the firing pulse signal. As shown in the previous Figure, $t_{step}$ is the period of the firing encoder signal which has been determined based on the properties of the media encoder signal and a reference signal.

Certain methods and systems described herein differ from comparative methods that synchronize one or more firing pulse signals based on a velocity of the print media determined from one or more encoder signals. If synchronization is based on the velocity of the print media then this results in the accrual of additional positional error due to the fact that there exists a delay between measuring the velocity of the media and modifying the firing pulse signal in response to that measurement. Consequently, this leads to an additional, undesirable printing error.

Certain methods and systems disclosed herein mitigate the effects of positional errors by modifying the firing pulse signal based on a position follower method as opposed to a velocity follower method.

Certain examples described herein can be used to improve print quality. The solution of correcting firing pulse signals based on the position of a print media, as opposed to the speed of a media provide greater printing robustness. For example in the case of page-wide array printing, the levels of mismatch in a print using the methods disclosed herein are reduced considerably. In those circumstances, increased fluctuations and perturbations due to the printing being in the media axis as opposed to across the width of the page in the scan axis can lead to increased print defects and print medium/nozzle misalignment. The systems disclosed herein can be used to reduce the impact of these fluctuations.

While examples, presented herein are described with, reference to inkjet printing systems, it will be appreciated that the methods and systems may also be, applied to any other kind of print system in which relative motion between heads (or similar) and print media may suffer from print errors caused by a lack of synchronization between a firing pulse signal (or equivalent) and the relative movement of a respective print medium.

Figure 8:
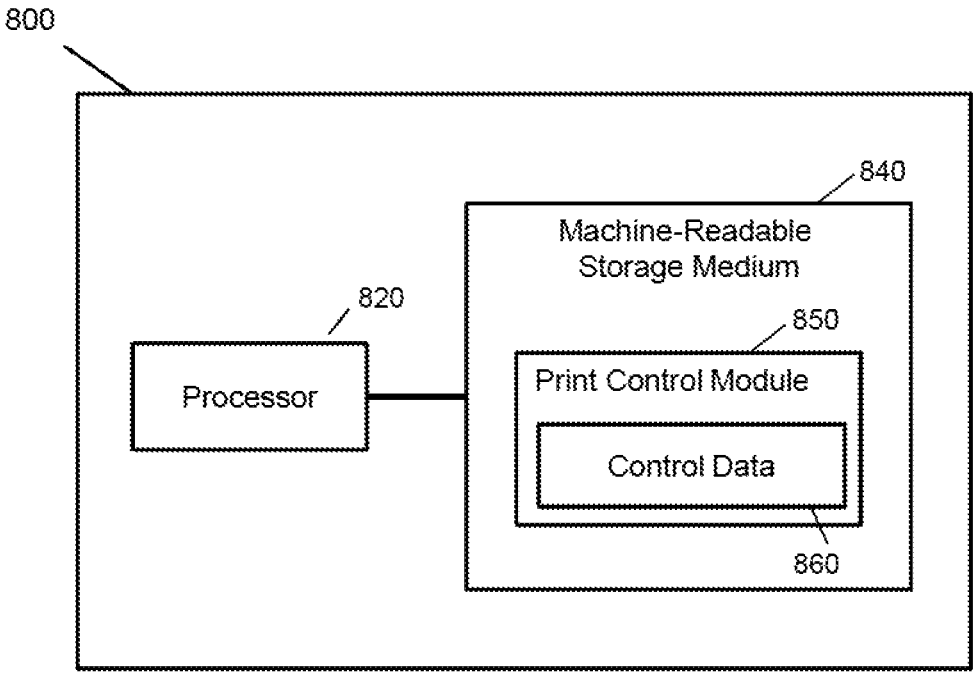
FIG. 8 is a schematic diagram showing an exemplary computer system according to an example.

Certain methods and systems as described herein may be implemented by a processor that processes program code that is retrieved from a non-transitory storage medium. FIG. 8 shows an example 800 of a device comprising a machine-readable storage medium 840 coupled to a processor 820. The device may comprise a computer and/or a printing device. Machine-readable media 840 can be any media that can contain, store, or maintain programs and data for use by or in connection with an instruction execution system. Machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc. In FIG. 8, the machine-readable storage medium comprises program code to implement a print control module 850 as in the foregoing examples described herein, and data representative of one or more print control data streams 860.

Similarly, it should be understood that a controller may in practice be provided by a single chip or integrated circuit or plural chips or integrated circuits, optionally provided as a chipset, an application-specific integrated circuit (ASIC), field-programmable gate array (FPGA), etc. For example, this may apply to all or part of a controller or other printer control circuitry. The chip or chips may comprise circuitry (as well as possibly firmware) for embodying at least a data processor or processors as described above, which are configurable so as to operate in accordance with the described examples. In this regard, the described examples may be implemented at least in part by computer program code stored in (non-transitory) memory and executable by the processor, or by hardware, or by a combination of tangibly stored code and hardware (and tangibly stored firmware).

The preceding description has been presented to illustrate and describe examples of the principles described. This description is not intended to be exhaustive or to limit these principles to any precise form disclosed. Many modifications and variations are possible in light of the above teaching.

What is claimed is:

1. A method of controlling a print device comprising:

determining, at a reference time, a position of a print medium within the print device based on a media encoder signal;

generating a firing encoder signal by varying one or more characteristics of a reference signal based on at least the position of the print medium at the reference time, wherein the one or more characteristics are varied such that a position of the print medium predicted using the varied characteristics matches a position of the print medium predicted using the media encoder signal, and wherein the firing encoder signal is used to synchronize firing of at least print head of the print device relative to the reference time.

2. The method of claim 1, wherein the reference signal has a time period representing a movement of the print medium over a predetermined distance and generating a firing encoder signal comprises:

determining an error between a predicted distance moved by the print medium based on at least the determined position of the print medium at the reference time and the predetermined distance; and using at least the error to vary the time period of the reference signal to generate the firing encoder signal.

3. The method of claim 1, wherein determining a position of a print medium based on a media encoder signal comprises:

receiving a rotary encoder signal from a media transport of the print device; and processing the rotary encoder signal to generate the media encoder signal, the media encoder signal representing a speed of the print medium, said processing comprising calibrating for a media type of the print medium.

4. The method of claim 1, comprising:

sampling the media encoder signal, wherein the reference time comprises a time at which the media encoder signal is sampled;

determining a time difference between the reference time and an end of a first period for the reference signal;

predicting a first position of the print medium at the end of the first, period based on at least the time difference and the determined position;

predicting a second position of the print medium at the end of a second period for the reference signal; and determining a travel time for the print medium to move from the first position to the second position, wherein the travel time is used to generate the firing encoder signal.

5. The method of claim 4, comprising:

determining a speed of the print medium; and using the speed of the print medium to predict the first position of the print medium and to determine the travel time.

6. The method of claim 1, wherein determining a position of a print medium comprises receiving the media encoder signal and generating the firing encoder signal comprises receiving a previous firing encoder signal as the reference signal.

7. The method of claim 1, comprising:

generating a firing pulse signal for the at least print head using the firing encoder signal, the firing pulse signal having a time period determined by dividing a time period for the firing encoder signal by a number of required firing pulses.

8. A print control system for a print device comprising:

a media encoder module arranged to receive a signal from an encoder coupled to a media transport of the print device and to generate a media encoder signal that is useable to determine a position of a print medium being transported by the media transport; and a firing encoder module arranged to synchronize a firing encoder signal with the media encoder signal, wherein the firing encoder module is arranged to synchronize the firing encoder signal with the media encoder signal using a position follower, such that a position of the print medium predicted from the firing encoder signal follows a position of the print medium predicted from the media encoder signal.

9. The print control system of claim 8, wherein:

the firing encoder signal is synchronized by modifying a time period of the firing encoder signal, such that a position of the print medium at the end of the time period that is predicted from the firing encoder signal matches a position of the print medium at the end of the time period that is predicted from the media encoder signal.

10. The print control system of claim 8, wherein the firing encoder signal has a time period representing a movement of the print medium over a predetermined distance and the firing encoder module is arranged to:

obtain a position of a print medium at a reference time from the media encoder signal;

determine an error between a predicted distance moved by the print medium based on the obtained position of the print medium and the predetermined distance; and use at least the error to vary the time period of the firing encoder signal.

11. The print control system of claim 8 wherein the media encoder module arranged to:

process the signal from the encoder to determine a media encoder signal indicative of a speed of the print medium; and determine a position of the print medium at a reference time from the media encoder signal, wherein the determined position is used by the firing encoder module to predict a first future position of the print medium after the reference time, and wherein the firing encoder module is arranged to determine a second future position of the print medium after the reference time based on a time period of the firing encoder signal at the reference time, the firing encoder module being arranged to match the first and second future positions to synchronize the firing encoder signal.

12. The print control system of claim 11, wherein the media encoder module is arranged to filter the signal from the encoder based on at least one of:

one or more media properties of the print medium; and one or more hardware properties of the print device.

13. A printing system comprising:

one or more print heads arranged to deposit printing fluid onto a print medium;

a media transport arranged to transport the print medium in relation to the one or more print heads;

an encoder coupled to the media transport and arranged to generate an encoder signal indicative of movement of the print medium by the media transport; and a print control module arranged to receive the encoder signal from the encoder and to generate a firing pulse signal to control the one or more print heads, wherein the print control module is arranged to synchronize the firing pulse signal based on the encoder signal, the print control module being arranged to synchronize the firing pulse signal by minimizing an error between a position of the print medium predicted based on a timing for the firing pulse signal and a position of the print medium predicted from the encoder signal.

14. The printing system of claim 13, wherein the print control module is arranged to process the encoder signal based on at least one of:

one or more media properties of the print medium, and one or more hardware properties of the print device, to generate a media encoder signal useable to determine one or more of:

a position of the print medium during transport; and a speed of the print medium during transport.

15. The printing system of claim 13, wherein the print control module is arranged to generate the firing pulse signal based on a digital encoder signal, the print control module being arranged to set a time period of the digital encoder signal, and wherein the position of the print medium predicted based on a timing for the firing pulse signal comprises a position predicted based on the digital encoder signal.

* * * * *